US005699649A

United States Patent [19]

Abrams et al.

[11] Patent Number: 5,699,649

[45] Date of Patent: Dec. 23, 1997

[54] METERING AND PACKAGING DEVICE FOR DRY POWDERS

[76] Inventors: Andrew L. Abrams, 26 Imperial Ave., Westport, Conn. 06880; Anand V. Gumaste, 7 Ardsley Ct., Robbinsville, N.J. 08691

[21] Appl. No.: 677,340

[22] Filed: Jul. 2, 1996

[51] Int. Cl.[6] ..... B65B 1/30

[52] U.S. Cl. ..... 53/428; 53/111 R; 53/235; 53/467; 53/473; 53/266.1; 53/502; 53/503; 141/DIG. 1; 198/690.1; 198/691

[58] Field of Search ..... 198/690.1, 691; 141/DIG. 1; 53/111 R, 266.1, 235, 428, 467, 473, 502, 503

[56] References Cited

U.S. PATENT DOCUMENTS

| | | | |
|---|---|---|---|
| 3,241,625 | 3/1966 | Soojan | 53/502 X |
| 3,437,074 | 4/1969 | Hagopian et al. | 198/690.1 X |
| 3,889,636 | 6/1975 | Smith . | |
| 3,943,437 | 3/1976 | Mourier . | |
| 3,999,119 | 12/1976 | Bares . | |
| 4,021,587 | 5/1977 | Banker | 141/DIG. 1 X |
| 4,071,169 | 1/1978 | Dunn . | |
| 4,170,287 | 10/1979 | Edward et al. | 198/690.1 X |
| 4,204,766 | 5/1980 | Harada . | |
| 4,252,434 | 2/1981 | Nakamura et al. | 198/690.1 X |
| 4,399,699 | 8/1983 | Fujishiro . | |
| 4,555,174 | 11/1985 | Kramer | 141/DIG. 1 X |
| 4,594,901 | 6/1986 | Norman . | |
| 4,848,267 | 7/1989 | Slayton et al. | 141/DIG. 1 X |
| 4,878,454 | 11/1989 | Cann . | |
| 5,005,516 | 4/1991 | Speer . | |
| 5,102,045 | 4/1992 | Diana . | |
| 5,214,386 | 5/1993 | Singer et al. . | |
| 5,454,271 | 10/1995 | Yamamoto et al. . | |

FOREIGN PATENT DOCUMENTS

| | | | |
|---|---|---|---|
| 4277126 | 10/1992 | Japan | 198/690.1 |

*Primary Examiner*—Daniel Moon

*Attorney, Agent, or Firm*—Hayes, Soloway, Hennessey, Grossman & Hage, P.C.

[57] ABSTRACT

Electrostatic phototechnology is used to package microgram quantities of fine powders such as drugs. An electrostatic "image" having a given size and charge density is exposed to ionized drug powder to attract a known amount of drug to the image. The resultant drug "image", is then transferred to a package.

12 Claims, 6 Drawing Sheets

METERING AND PACKAGING DEVICE FOR DRY POWDERS

BACKGROUND OF THE INVENTION

The present invention relates to the packaging of dry powders and particularly to the packaging of microgram quantities of powders for medical uses. In the metering and packaging of dry powders, particularly very small amounts of dry powder medications, the drug industry has had difficulty with the packaging of precise amounts of such powders. One of the reasons for this is that many powders develop an electrical charge and the charge causes problems in measuring and packaging since powders tend to aggregate and stick to the sides of the containers and metering devices. The present invention utilizes this ability of the powder to acquire an electrical charge for precisely measuring exact microgram quantities of the powder and then placing these exact microgram quantities in individual containers.

In the past, technology has been used employing electrostatic charge to attract a given quantity of powder to a surface. An example of this is the laser printer or the electrostatic copy devices where a drum is charged and toner particles are attracted and held in position by the charge. The charge on the drum is neutralized by the attracted toner powder, thus limiting the amount of toner in accordance with the charge image on the drum. The charge on these printer drums is then transferred to a sheet of paper or other carrier to give a final image.

BRIEF DESCRIPTION OF THE INVENTION

In the present invention, the same technology is employed for transferring a predetermined amount of a finely powdered medication to a carrier or an intermediate such as a drum, carrying a charge of predetermined intensity and area, rotating the charged drum surface, carrying the predetermined amount of powdered medication on its surface, to a transfer station where the charge is overcome and the dry powder is transferred to a package which is then sealed. In lieu of a drum, a belt, or other movable surface is charged to a given potential in a localized area.

When a given amount of a powdered drug is to be packaged, the charge and area of charge can be experimentally determined for each dose of drug and each particle size distribution. This can be done by controlling either the charged area for a given charge density or the total electrostatic charge on any individual charged area. These conditions can be adjusted to provide the desired amount of the particular drug to be transferred at the transfer station.

A BRIEF DESCRIPTION OF THE DRAWINGS

DETAILED DESCRIPTION OF THE INVENTION

Figure 1:
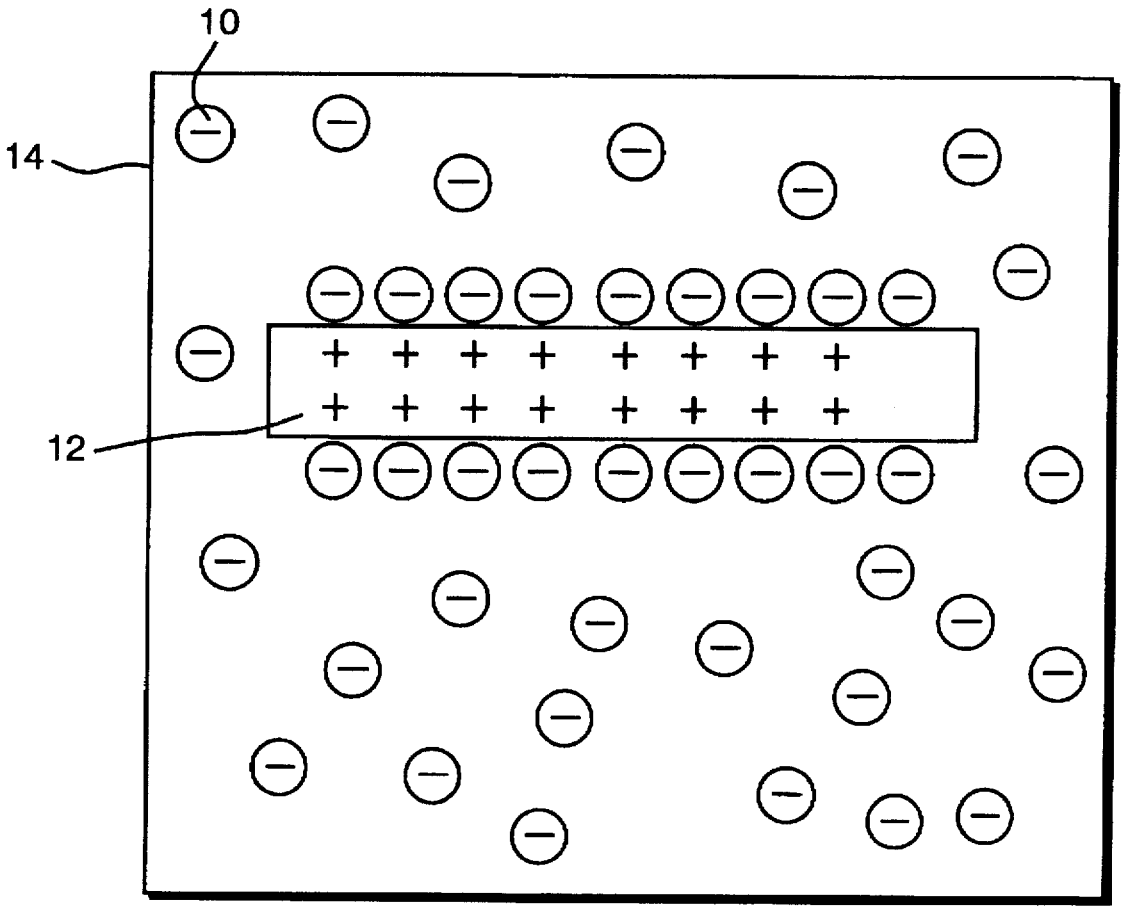
FIG. 1 shows a schematic representation of the attraction of negatively charged powder particles to a support having a positive charge on the surface thereof.

Referring first to FIG. 1 there is illustrated a chamber 14 containing aerosolized dry powder particles 10. These particles 10 are suspended in air and carry a charge, for example a negative charge. Also in the chamber is a support surface 12 having a charge opposite to that on the particles. The support surface 12 will attract a number of charged particles 10 sufficient to neutralize the charge on the surface of the support 12. This support surface is one that can hold a discrete electrical charge on its surface, such as insulating material, e.g. plastic or a semiconductor material, such as selenium, used in the photocopy industry.

The actual amount of powder transferred to the carrier sheet is a function of the mass to charge ratio of the powdered particles. If one assumes surface charge saturation, the amount of charge carried by the particles is directly related to the surface area. For spheriodal particles, the charge varies as the square of the radius and the mass varies as the cube. Thus, the amount of charged particles picked up by a given portion of the surface of the charge carrier will be a function the total charge on the carrier. Thus, with a given surface charge density on the carrier, the amount of powder picked up is directly proportional to the charged area. Thus, for doubling the amount of powder to be picked up, the area on which charge is placed can be doubled. This can be used as a basic method to control the amount of powder to be picked by the carrier. Thus, for any particular powder or particle size distribution of powder, the exact area and amount of charge needed can be experimentally determined.

Figure 2:
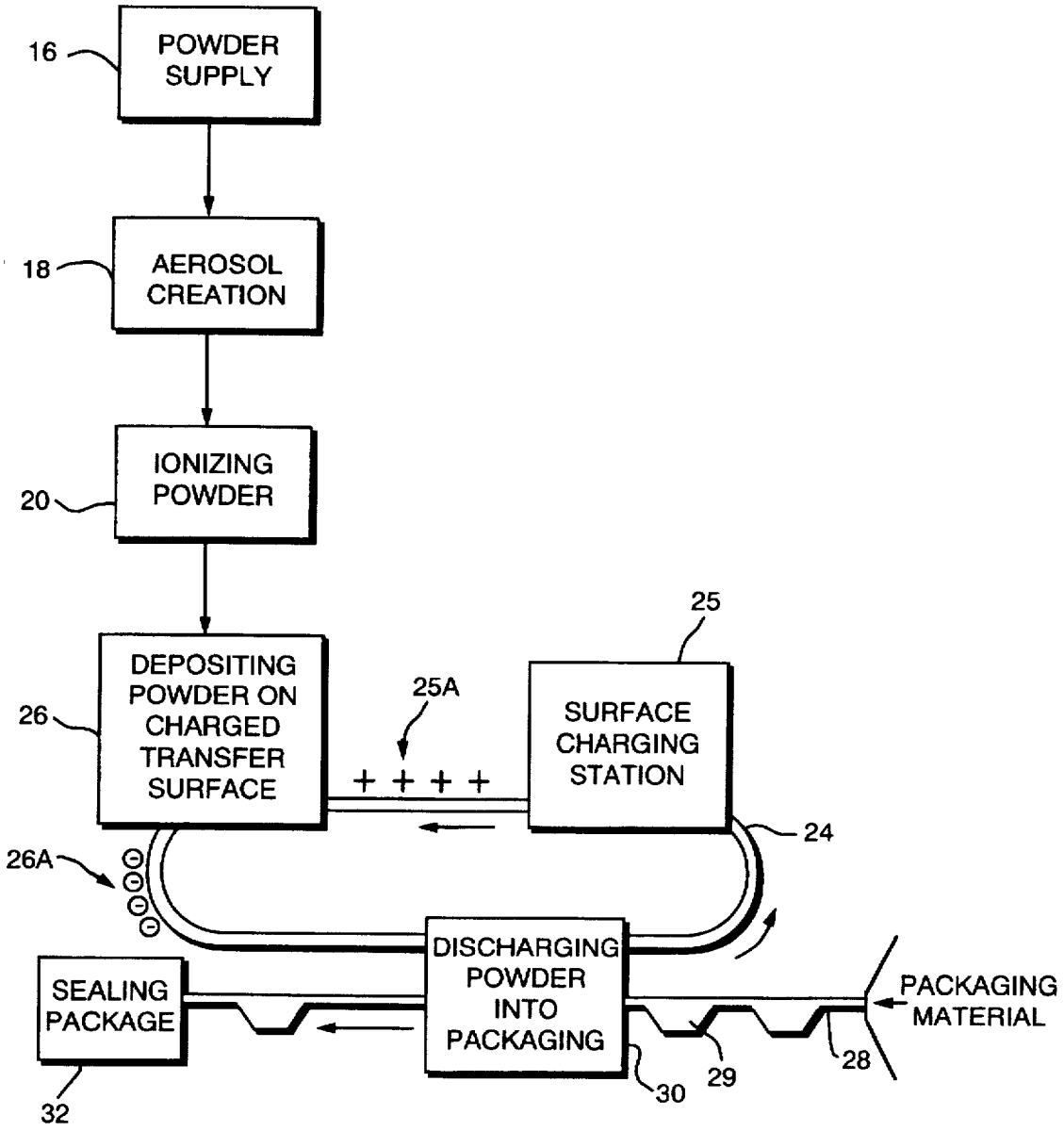
FIG. 2 shows a block diagram of the various steps involved in practicing the invention.

Referring now to FIG. 2, there is a schematic flow diagram of the various items of equipment needed to perform in the total process from powder supply to a sealed package containing a specified amount of powder in the package. At 16 is indicated the powder supply which is fed into a device 18 for creating an aerosol of the powder. Next the powder particles are ionized at 20. As will be indicated later, a number of these steps and pieces of equipment can be combined. At 24 is indicated a carrier surface capable of maintaining a space charge on its surface. This can be a plastic belt, for example, or a selenium drum of the type used in Xerox™ photocopiers. This carrier surface 24 is passed through a charging station 25 where predetermined electrostatic charge 25A (an electrostatic "image") is created on a predetermined area of the transfer surface. This charged surface 25A then passes through a step 26 wherein powder is deposited on the carrier surface in a sufficient amount 26A to neutralize the charge carried by the carrier surface. Thereafter, the carrier surface, carrying the predetermined amount 26A of powder on its surface, is passed to a powder discharging device 30 which discharges the powder 26A from the surface 24 onto a packaging material 28, which may have indentations 29 for receiving the powder. The packaging material 28 containing its charge of powder 26A, then passes through a package sealing step 32.

As mentioned previously in discussing FIG. 1, the carrier surface with the electrostatic charge carries a known amount of charge on its surface and the polarity of this charge is opposite to that of the powder particles suspended in the chamber. The charged particles migrate to the charged surface because of the attraction by the opposite nature of the charges. This migration of the particles continues until the charge on the carrier surface is neutralized.

The actual amount of powder mass transferred to the carrier surface is a function of the mass to charge ratio of the charged particles. Although it is difficult to achieve a linear relationship between the mass and the actual charge, it is possible to establish a fixed relationship between the surface area of the powder particles and the charge the powder particle is carrying at charge saturation. However, the surface area of a mixed group of powder particles of different sizes and shapes can be extremely difficult to calculate mathematically, particularly when the shapes are irregular, (e.g. non spherical, microcrystalline, etc.) As mentioned earlier, the simplest method of determining the amount and area of charge to attract a given weight of particles is to estimate the correct area and charge and then apply the estimated charge to the estimated area on the carrier surface 24 and expose this selectively charged area to a mass of powder which has been ionized in the ionizing step. The amount of powder deposited can then be readily measured at the discharge step. Thereafter, either the size of the charged area or the amount of charge applied to the area at the charging station 25 can be adjusted upwardly or downwardly to provide the correct amount of charge, both in area and charge intensity, for picking up a desired weight of oppositely charged powder.

Figure 3:
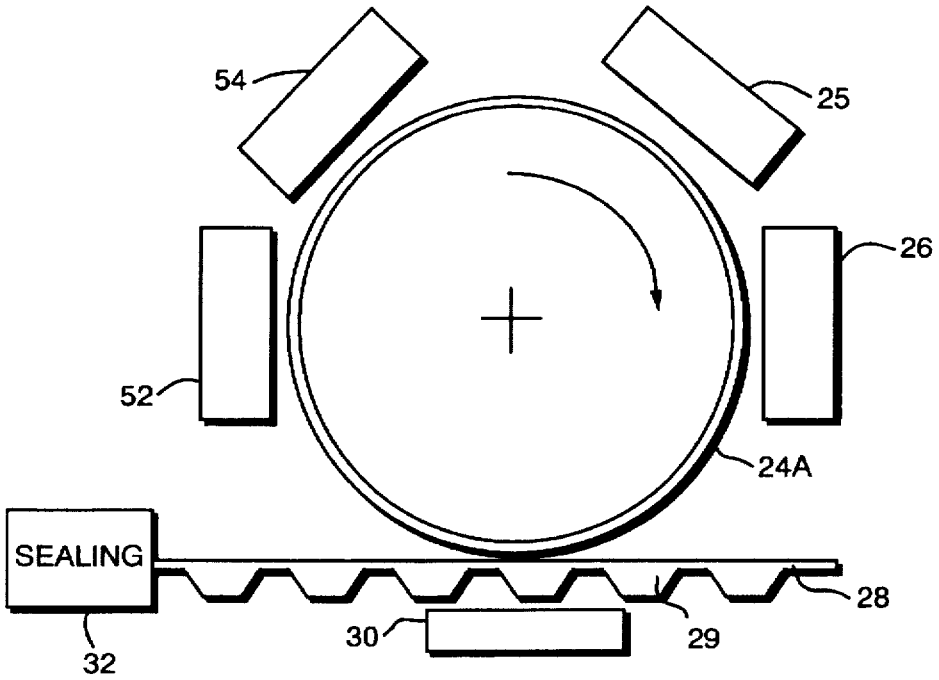
FIG. 3 is a schematic representation of one form of drum type electrostatic device for transferring given small quantities of powdered drugs from an electrostatic attraction station, where a given quantity of powdered drug is attracted to and neutralizes a given charge on the drum, and a subsequent transfer station where the drug is transferred from the drum to a package therefor.
Figure 4:
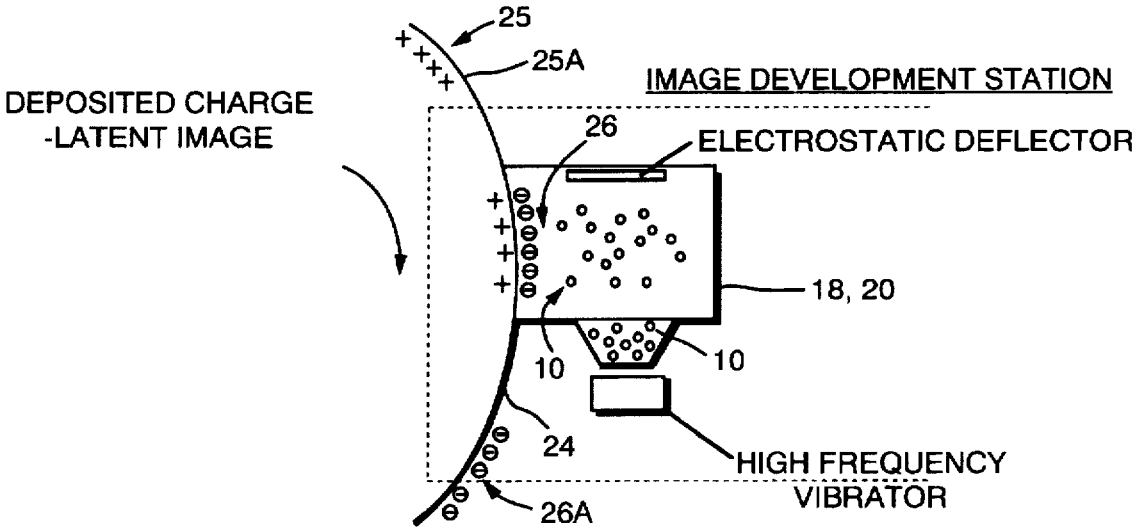
FIGS. 4 and 5 are schematic functional representations of preferred components employed in the FIG. 3 type of apparatus.
Figure 5:
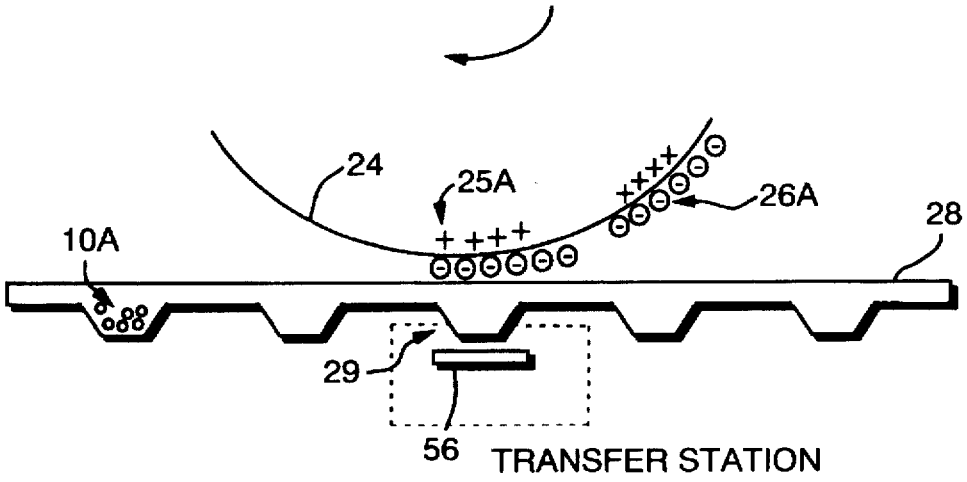

Referring now to FIGS. 3, 4, and 5 one preferred apparatus for accomplishing the invention is illustrated schematically in FIG. 3, with details of the components thereof being shown in FIGS. 4 and 5. The charge carrying surface is illustrated as a photo sensitive drum 24A which rotates between the charge "image" exposure 25 which creates a charge "image" 25A on the surface of the drum 24A. (see FIG. 4) This "image" exposure can be a light source e.g., a laser beam (or other controllable photon source), which is capable of creating an electrostatic "image" 25A on the surface of the drum of a desired size and charge density. The charge "image" 25A is then rotated to the image development station containing an ionized cloud of drug powder which is attracted to the charge "image" 25 to neutralize charge in the "image", thus, forming a powder "image" 26A containing a predetermined amount of powder. (see FIGS. 4 and 5) This powder "image" 26A is rotated to a drug transfer station 30 where it is released into the pockets 29 in the packaging layer 28. This transfer to the pockets 29 is accomplished, in one preferred embodiment, by the use of high voltage plate 56 (see FIG. 5) which overcomes the attraction of the charged "image" 25A on the surface of the drum, thus releasing the powder "image" 26A into the pocket 29. The pocket containing the predetermined quantity of drug is then passed through the sealing step 32.

Figure 6:
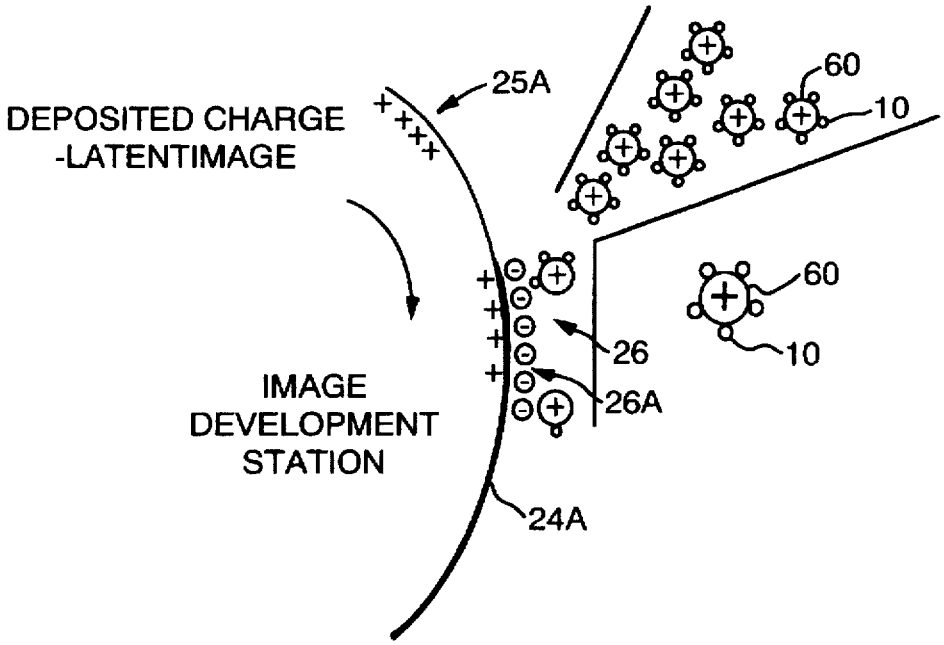
FIG. 6 shows a different system wherein separate carriers, having micronized drug particles electrostatically attached to their surface, are used to carry the drug to the charged transfer surface.

FIG. 6 shows another embodiment of the invention wherein the micronized drug particles 10 are carried on the surface of discrete carriers 60 which can be small plastic beads, for example. When these plastic beads are contacted with an image 25A, the micronized particles 10 are transferred to the charge "image" 25A on the surface of the drum 24A from the discrete carrier balls 60. To accomplish this, the positive charge on the image 25A should be higher than the positive charge on the surface of the individual carriers 60.

Figure 7:
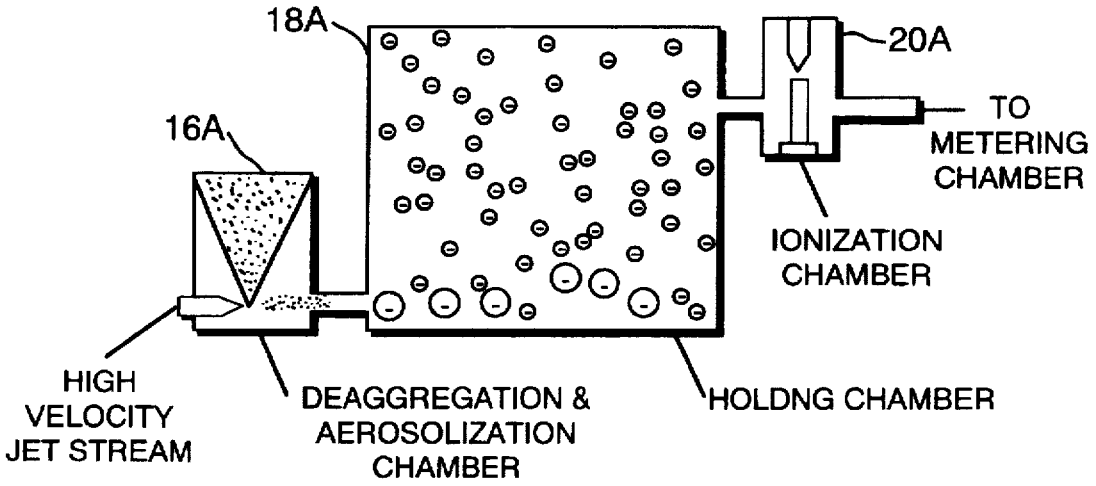
FIGS. 7 and 8 show methods of aerosolizing the powdered drug and ionizing the drug to give it a specific charge.
Figure 8:
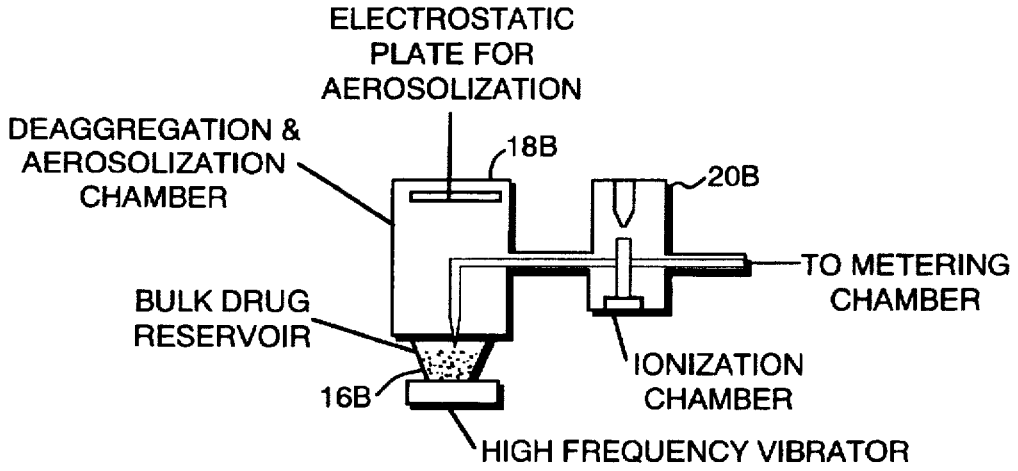

FIGS. 7 and 8 show additional details of means for both handling drugs and providing aerosolization and ionization to provide a suspended stream of free drug powders having a predetermined size and charge. In FIGS. 7 and 8, elements 16A, 18A and 20A and 16B, 18B and 20B correspond to the equivalent elements in FIGS. 2, 3 and 4.

Since repeatability is important for drug metering it is necessary to effectively address the issue of charge to mass variation with particle size. One method of over-coming this problem is to control the particle size distribution in the chug powder. FIG. 8 shows one implementation to achieve this control of particle size. The voltage on the electrostatic deflector is adjusted to control the particle sizes to be suspended in the holding chamber for delivery to the ionization chamber. Once the desired particle sizes are suspended they are drawn into the ionization chamber to ensure surface charge saturation on the particles. This will give a known charge to the mass ratio.

Figure 9:
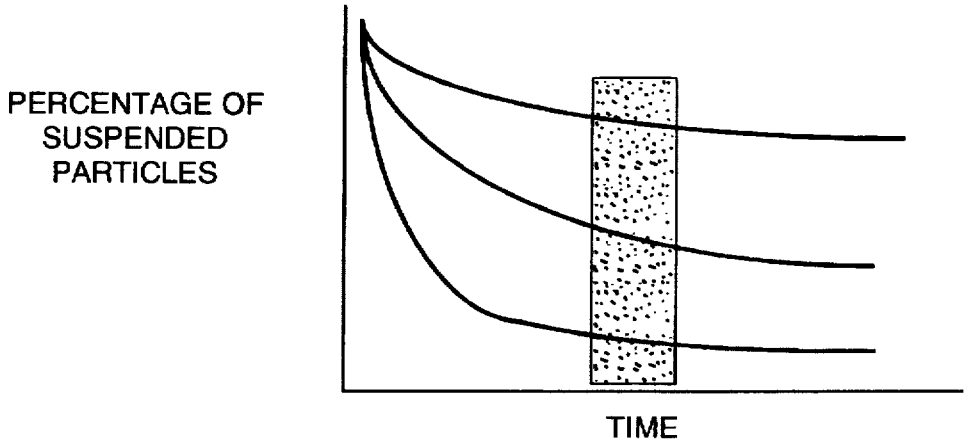
FIG. 9 shows a graph illustrating the percentage of suspended particles as a function of time and size, permitting creation of a suspended particle stream of any given desired size distribution.

FIG. 7 shows an alternative means for controlling the size distribution. A high velocity air stream is used to deaggregate the powder. The deaggregated powder is then contained in holding chamber 18A. The purpose of the holding chamber is to allow the larger size particles to settle, thereby producing a favorable particle size distribution. The particle size distribution is a function of the holding time as shown in FIG. 9. The suspended particles are then ionized and exposed to the charge image as shown in at 26 in FIG. 3

FIG. 9 shows the percentage of particles sizes suspended in a holding chamber as a function of time. Such a chamber may be provided with a slow upward flowing air current to maintain the aerosol suspension. As can be seen, the percentage of suspended particles is very largely determined by particle size. Through experiment one can select a time slot that will give the desired particle size distribution for any particle drug dosage. Additionally, or in place of settling time, one or more filters can be used for obtaining a given particle size range.

Figure 10:
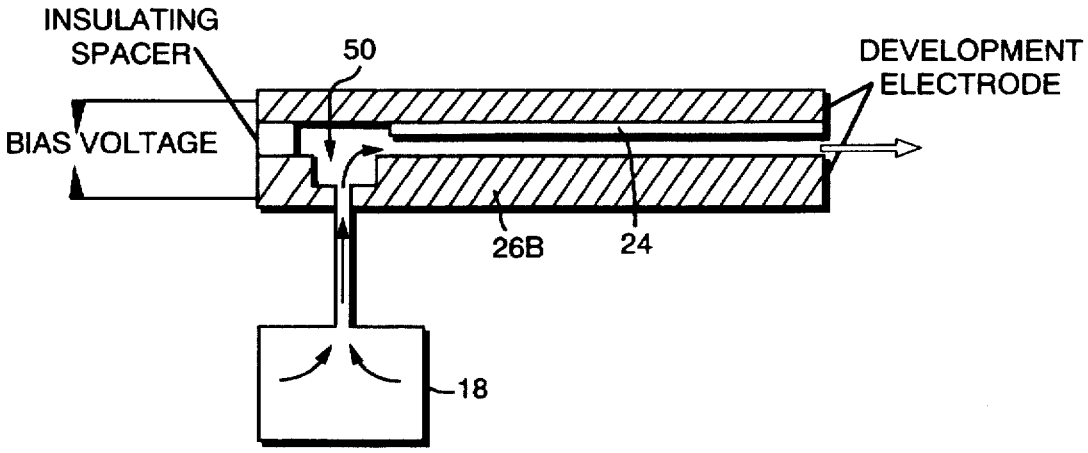
FIG. 10 shows another embodiment of applying the aerosolized drug to a drum carrying charge "image".

FIG. 10 is similar to FIG. 4 except that the Image Development Station 26 in this figure is replaced with the Stationary electrode 26B and an air passageway 50 for carrying the aerosolized powder. The rotating drum has a dielectric or photoreceptor surface 24 on to which is deposited the latent image. As an example the aerosolization chamber would be similar to that shown in FIG. 7. The metering chamber in FIG. 7 is then the air-passageway 25 between the dielectric surface 24 and the stationary electrode 26B. The undeposited powder then exits at the right side of this air-passageway to be collected for later use or recirculated back into the aerosolization chamber.

Figure 11:
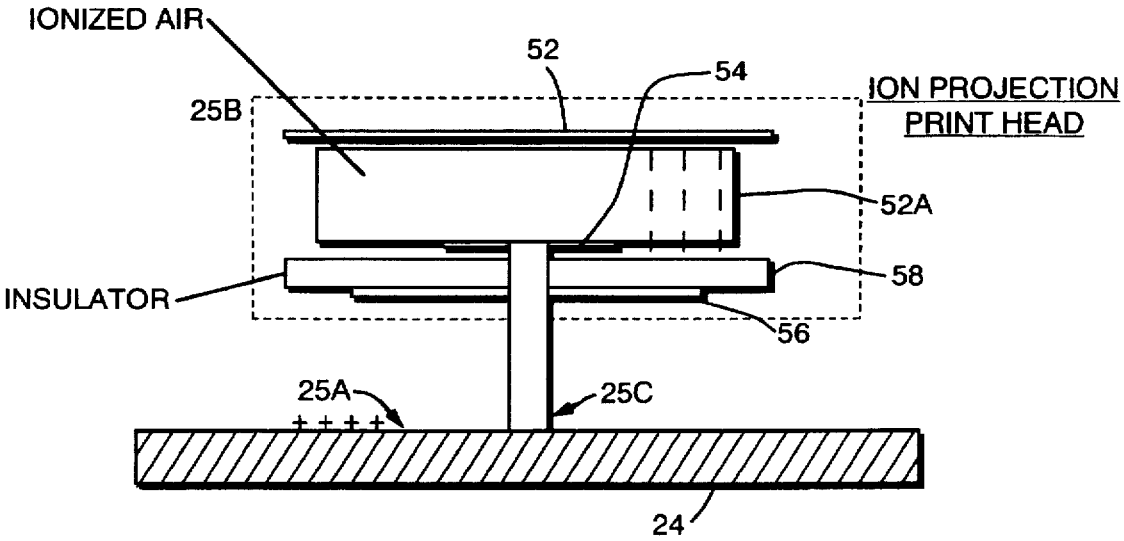
FIG. 11 illustrates an ion projection system for creating the charge "image" on a dielectric surface.

FIG. 11 above shows an ion projection print head where an ion beam is used to produce a charge "image" on a dielectric surface. The corona wire 52 has a high voltage applied to it which causes the air to breakdown and produces the ions 52A necessary for the operation of the ion projection printers. The remainder of the ion projection print head includes the usual control electrode 54, screen electrode 56 and insulator 58. The relative potential that is applied to the control and screen electrodes then regulates the amount of ions 25C that will be metered and deposited on to the dielectric surface 24 these ions being deposited on the surface to form the latent image 25A. Both the intensity and size of the ion beam can be adjusted as will be apparent to one of ordinary skill in the art. The advantage of this system is that it does not require a photosensitive surface and can therefore be rugged making it suitable for the manufacturing environment.

We claim:

1. The method of packaging powder comprising the steps of developing a predetermined electrostatic charge having a predetermined "image" area on a powder carrier surface, contacting said carrier surface with a sufficient amount of powder to neutralize said charge, moving said powder and said surface to a transfer station, transferring said powder to a package and sealing said package to contain said amount of transferred powder.

2. The method of claim 1 wherein said predetermined charge and area on said carrier surface are estimated, said estimated electrostatically charged area is then exposed to said powder of opposite charge and the amount of powder attracted to said predetermined area is measured, thereafter necessary adjustments to the amount of charge and/or the area is made to attract the predetermined desired amount of powder to said "image" area.

3. The method of claim 2, where a high velocity air stream is used to deaggregate and aerosolize the powder particles and a holding chamber is used to control the particle size distribution in the air stream using particle settling times.

4. The method of claim 2, wherein means are provided for controlling particle size distribution of particles in the powder deposited on the charge "image".

5. The method of claim 1, wherein the charge "image" is produced by an ion beam whose intensity and/or area can be varied.

6. The method of claim 1, wherein the charge "image" is produced by a photon beam whose intensity and/or area can be varied.

7. Apparatus for packaging for powder comprising:

a source of powder, a powder carrier surface;

means for applying a predetermined electrostatic charge to a predetermined area of said carrier surface, to create a charge "image" on said surface, means for applying to said powder an electrostatic charge opposite to that of said electrostatic charge on said carrier surface;

means for exposing said charged area of said area on said carrier surface to charged powder to create a powder "image" on said carrier surface, means for transferring said powder adhering to said carrier surface to a transfer system and neutralizing said electrostatic charge on said carrier surface to cause the powder to transfer into a package, therefor, and;

means for sealing said package.

8. The apparatus of claim 7 wherein the means for placing the electrostatic "image" on the carrier surface is adjustable both in intensity and area so that the exact amount of electrostatic charge and area thereof can be controlled.

9. The apparatus of claim 7, which additionally includes a means to control the powder particle size distribution to ensure repeatability and accuracy of powder metering.

10. The apparatus of claim 9, where a high frequency vibrator such as a piezo crystal, electromagnetic, mechanical or other means is used to deaggregate the powder and an electrostatic potential is used to aerosolize the particle size distribution of interest.

11. The apparatus of claim 7, wherein the charge "image" is produced by an ion beam whose intensity and/or area can be varied.

12. The apparatus of claim 7, wherein the charge "image" is produced by a photon beam whose intensity and/or area can be varied.

* * * * *